United States Patent [19]

Hartfeil

[11] Patent Number: 4,872,705

[45] Date of Patent: Oct. 10, 1989

[54] CONFIDENTIAL POST CARD

[75] Inventor: Guenther Hartfeil, Dayton, Ohio

[73] Assignee: Charles Jones, Dayton, Ohio ; a part interest

[21] Appl. No.: 229,687

[22] Filed: Aug. 8, 1988

[51] Int. Cl.[4] ..... B42D 15/00; B42D 15/04; B42D 15/02; G09F 3/00

[52] U.S. Cl. ..... 283/67; 283/81; 283/98; 229/92.8

[58] Field of Search ..... 229/92.8, 69, 70, 73, 229/1 B, 165 R; 283/6, 56, 57, 58, 67, 81, 108, 98; 282/25, 27.5; 40/138

[56] References Cited

U.S. PATENT DOCUMENTS

| | | | |
|---|---|---|---|
| 89,507 | 4/1869 | Saladee . | |
| 709,805 | 9/1902 | Stearns et al. . | |
| 816,870 | 3/1906 | Markoff . | |
| 1,957,374 | 5/1934 | Unger | 233/1 |
| 2,321,184 | 6/1943 | Butterworth | 283/81 |
| 2,363,472 | 11/1944 | Ritter | 283/81 |
| 2,666,655 | 1/1954 | Wolowitz | 282/25 |
| 2,805,816 | 9/1957 | Morgan | 229/92.8 |
| 3,126,211 | 3/1964 | Hieken et al. | 283/6 |
| 3,261,623 | 7/1966 | Kiedrowski | 282/25 |
| 3,329,333 | 7/1967 | Ormond | 229/92.5 |
| 3,713,238 | 1/1973 | Hyman et al. | 40/138 |
| 3,899,127 | 8/1975 | Melander | 229/73 |
| 4,009,892 | 3/1977 | Nickerson | 283/67 |
| 4,017,994 | 4/1977 | Fraser | 283/67 |
| 4,172,605 | 10/1979 | Welsch et al. | 282/275 |
| 4,272,327 | 6/1981 | Logan | 283/81 |
| 4,278,199 | 2/1981 | Tanaka | 229/92.8 |
| 4,428,526 | 1/1984 | Riley | 229/92.8 |
| 4,589,590 | 5/1986 | McGuire et al. | 229/92.8 |
| 4,763,931 | 8/1988 | Matsuguchi | 283/81 |

*Primary Examiner*—Frank T. Yost
*Assistant Examiner*—Paul M. Heyrana, Sr.
*Attorney, Agent, or Firm*—Biebel, French & Nauman

[57] ABSTRACT

A post card for sending confidential information comprises a stiff rectangular card body measuring no less than 3.5 inches by 5 inches, no greater than 4.5 inches by 6 inches (in certain cases no greater than 6 inches by 10 inches), and has a face on which postage and at least a recipient's (addresses) address are to appear. A sender's return address may also appear on the face of the card body. A predetermined area of the face may be covered with an opaque address label, bearing either the addressee's or the sender's address, and having an exposed surface and a reverse surface securable (at least around its entire periphery) to the card body to conceal the indicia which conveys the confidential information at the label/card face interface. The label is secured to the card body in such manner than tampering with said label will be detactable by the recipient.

12 Claims, 9 Drawing Sheets

CONFIDENTIAL POST CARD

This invention relates to post cards which are specifically intended to covey special information in confidence. The U.S. Postal Service has quite stringent regulations regarding what is entitled to treatment as a post card. A reduced rate is applicable if, and only if, these regulations are fully met. At present, the post card rate is $0.15 and the First Class rate for a one ounce letter is $0.25, without taking into account the economies available by pre-sorting and/or pre-application of Zip+4 codes and/or bar codes to bulk mailings. The principal benefit of such a post card would be a substantially reduced postage cost utilizing First Class post cards versus First Class sealed envelopes. The savings may vary from 8¢ to 10¢ (U.S.) depending upon the sneder's ability to utilize presort, zip+4, pre-barcoded and/or carrier route sort. There is also a significant savings between the cost of volume-purchased post cards and business letterhead and envelopes. Typically, this savings per post card versus one sheet of business letterhead and one envelope may be in the order of 1.61¢.

BACKGROUND OF THE INVENTION

The U.S. postal regulations make a distinction between Postal Cards and post cards. A Postal Card is supplied by the Postal Service with a postage stamp printed or impressed on it. A post card is a privately printed mailing card of any light color which does not prevent legible addresses and postmarks from being placed thereon; brilliant colors are not permitted.

To qualify for mailing/handling at the First-Class card rate, the post cards must be: (a) not smaller than 3.5 inches by 5 inches, nor larger than (currently) 4.25 inches by 6 inches;

(b) rectangular in shape and of approximately the same form, quality and weight as postal cards (the weight basis is presently 125 grams per square meter);

(c) made of a piece of unfolded and uncreased paper or card stock of approximately the quality and weight as postal cards;

(d) of uniform thickness not less than 0.007 inch thick or greater than 0.0095 inch thick.

There are other regulations and restrictions regarding "double post cards" but these are not per se relevant to the present invention because such a double post card consists of two cards fitting the foregoing regulatings, one of which may be detached by the recipient and returned as a reply. Each card must have postage affixed, and must be secured in folded relation such that the inner folds of the cards ca be examined. Thus, a conventional double post card by definition cannot per se conceal confidential indicia, although the sending card (not the reply card) of a double post card can be prepared according to this invention to send confidential data.

It should be noted that post cards may be as large as 6 inches by 10 inches, although beyond the 4.5 inch by 6 inch size, the same postage is required as for a First Class letter. In some cases, the savings in materials, simplicity of recording/handling of information, and generally handling, may be attractive even without the ability to use the post card postage rates.

Post cards bearing "attachments" are not mailable at the rates for postal cards or post cards. However, labels affixed by adhesive for the purpose of showing the address and the return address are permitted. Thus, such labels if used according to the regulations can have an additional function of concealing confidential indicia.

Various proposals have been made for placing confidential data and/or indicia on post cards, and covering the confidential information with labels, laminates, or other means. The most notable of such prior art is U.S. Pat. No. 4,278,199, which teaches placing confidential information on either the face or the reverse side of a post card, and covering that information with an opaque removable label. However, that patent does not teach the use of an address label for this purpose, but instead uses a label which is plain or marked in some other way. This is not (and has not been) permissible under U.S. Postal Service regulations, since such a label is in effect a laminate not allowed within the post card requirements, and the resulting card/label combination cannot qualify for the reduced postage rate applicable to properly designed and used post cards. Thus, proposals of that tupe have only limited utility under U.S. Postal regulations.

In addition, of significant importance, U.S. Pat. No. 4,278,199 makes no reference to maintaining label security, yet this is quite important to the sender and recipient; the patent is limited to covering no more than half the card area; and there is no recognition of the desirability to adapt to automated handling and reading (in particular the addressee (recipient) addresses).

SUMMARY OF THE INVENTION

The present invention provides forms of post cards which can effectively convey confidential data, preferably in the form of concealed indicia, through the U.S. mail at First Class post card rates. According to the invention a post card useful for this purpose comprises a stiff rectangular card body measuring no less than 3.5 inches by 5 inches and having a face on which postage and at least a recipient's (addressee) address are to appear. Preferably, the card body will measure no greater than 4.5 inches by 6 inches, however in instances where using the invention is economically feasible even at full U.S. First Class mail rate, the card dimensions can be no greater than 6 inches by 10 inches. The postage is located in the upper right corner of the face of the card body, and may be a postage stamp, a pre-printed prepaid stamp impression, or the like, and can be applied either to the card body itself or the address and/or return address label. A sender's return address may also be applied to the face of the card body and/or a label.

On the face of the post card body there is a predetermined area, preferably but not necessarily apart from the postage, within which area confidential indicia may be placed by any suitable means which will not imprint through the card body. Obviously the confidential information would not be secure if an embossed version of the indicia appeared on the reverse side of the card body or the exposed surface of an address label.

An opaque label, having an exposed surface and a reverse surface securable (at least around its entire periphery) to the card body, is provided of a size and shape to cover that predetermined area, to conceal the indicia which conveys the confidential information (and related data if desired). The label is, after the indicia is placed on the predetermined area of the face of the post card, secured to the card body in such manner that tampering with said label will be detectable by the recipient. Various well known adhesives are available which will accomplish this purpose.

To meet the post card regulations this label has on its exposed surface the address of the recipient and/or the return address of the sender. Thus, the opaque label performs the required function of being an address label, and also serves to conceal the confidential information until such time as the label is removed (at least partially) by the recipient to reveal that information.

Considerable savings are available to institutions, in particular, which can be enabled by the invention to utilize post cards to convey secured confidential information to recipients (e.g. customers), especially taking advantage of available bulk mailing regulations as to pre-sorting and/or pre-fixing Zip+4 codes or bar codes to the post cards. For example, by appropriate use of these incentive features in the Postal Service regulations, it is possible to attain a per-card postage charge of $0.115, as compared to a charge of $0.25 for a one ounce First Class letter mailed randomly without using any of the available cost reduction incentives for such letters which, at maximum, can only save $0.045 per piece.

The principal object of the invention, therefor, is to provide a method for conveying confidential data from a sender to a recipient through use of special forms of post cards which comply with the Postal Service regulations for sending at the reduced First Class postage rates; and to provide forms of post card/address label combinations which accomplish this purpose.

Other objects and advantages of the invention will be apparent from the following description, the accompanying drawings and the appended claims.

DESCRIPTION OF THE PREFERRED EMBODIMENT

Figure 1:
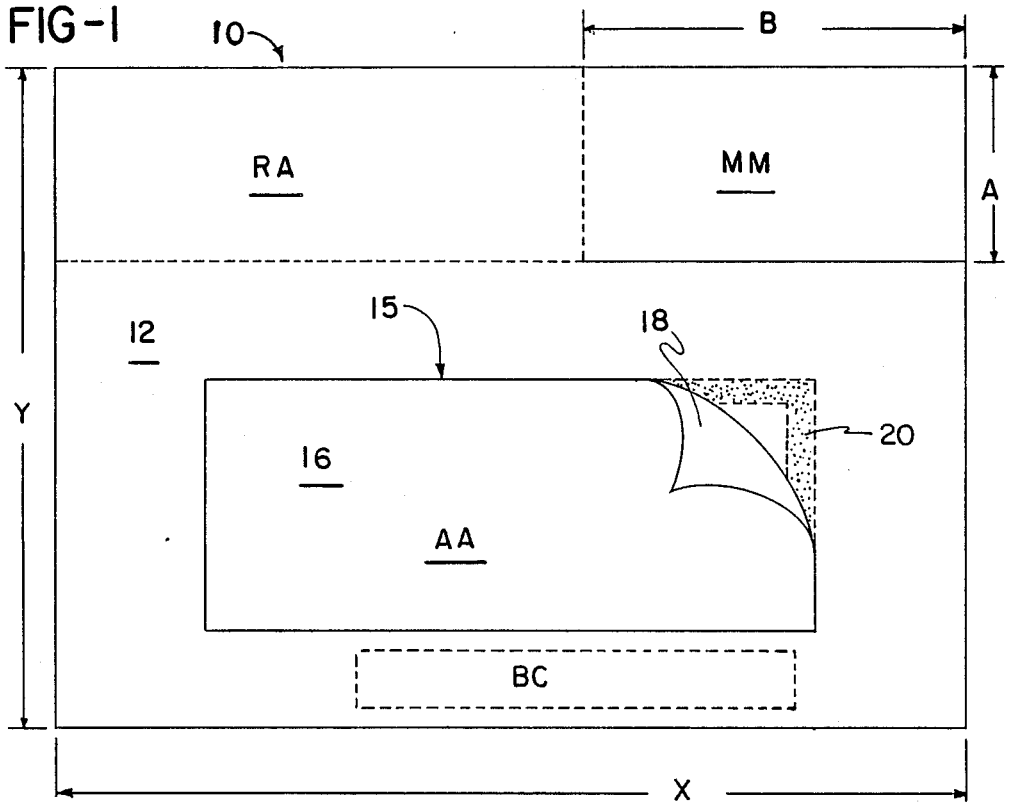
FIG. 1 is a plan view of a preferred embodiment of a post card constructed according to the invention.

The essential element of the present invention is the utilization of a card body 10 having a face 12 onto which is applied an address label 15, having an exposed surface 16 and a reverse surface 18. It should be noted that such address label may have either the recipient's address or the sender's return address, or both, placed or printed on the exposed surface. This label may occupy various areas of the card face 12, as hereafter explained, and it is made of suitable material which is opaque so as to conceal any information (decipherable indicia) recorded at the interface of the label reverse surface 18 and card face 12. The label 15 need not be rectangular, although that is the preferred shape.

This indicia can be recorded either on the card face 12, or the reverse surface 18 of label 15, or both. Thus, hereinafter the indicia is described as at the labelcard interface, where it may be applied to the reverse label surface 18, the portion of card face 12 covered by the label, or both. To assure confidentiality, it is necessary that the indicia be formed by some means which does not produce an imprint through either the label or the card body. For example, in FIG. 1 indicia could be imprinted within the area to be covered by label 15. It will be understood that in a typical embodiment the indicia is not visible, either by direct view or by means of back-lighting the card body.

Card body 10 is rectangular and has a height dimension Y which is no less than 3.5 inches (8.89 cm.) and a width dimension X which is no less than 5 inches (12.7 cm.); this is the minimum permissible size for a post card as prescribed by U.S. Postal Service regulations. In order to be acceptable for the First Class post card rate, height Y cannot be more than 4.25 inches (10.795 cm.) and width X cannot be more than 6 inches (15.24 cm.). If desired the Y dimension can be as much as 6 inches (15.24 cm.) and width X can be as much as 10 inches (25.4 cm.), however this extra size will require payment of the same postage as a First Class letter.

In the preferred embodiments described herein, the dimensions of card body 10 are 6 inches in the length dimension X and 4.25 inches in the height dimension Y. All other dimensions for the various areas and labels are based upon a card body of this size. Of course, the present invention is not limited to any of the dimensions set forth herein.

The card body 10 is formed from paper, card stock or equivalent, opaque, and having a basis weight corresponding to the requirements for Postal Cards, presently at least 125 grams per square meter. For enhanced automated handling of the post card, it is recommended by the U.S. Postal Service that the card have a stiffness of at least 500 milligrams along the length (X dimension) as measured in the Gurley scale.

For purposes of explanation and illustration, the card body is divided into a number of areas, it being understood that the exact dimensions and size relationships of these areas may be altered to fit the needs of a particular use. These areas are (1) The meter mark area The $2\frac{1}{2}''$ wide by $1\frac{1}{4}''$ high meter mark area MM seems typical from a studied sample. This size area is appropriate for accurately placed meter marks used for mass mailings at the lowest possible rate.

Current postal regulations require a $2\frac{1}{8}''$ minimum width from the right edge of the card for address, postage and postal endorsements. The entire height of the card is reserved for these three elements although the proportional heights are unspecified. The meter mark area could virtually encompass the entire card, but the $2\frac{1}{2}''$ by $1\frac{1}{4}''$ area specification is preferred.

(2) The return address area

The $3\frac{1}{2}''$ inch wide return address area RA can have a height of up to 2 inches if rectangular. A height of more than 2 inches encroaches on the address area and may hinder efficient postal processing.

Current postal regulations allow for a return address area of up to $3\frac{7}{8}''$ wide (on a 6" card), measured from the left edge of the post card with a height up to the entire height of the post card. For purposes of assuring efficient mail sorting and for paying the lowest possible postage costs, preferred specifications exclude the address and bar code areas shown from being overlapped by the return address area or label.

(3) The address area

Figure 2:
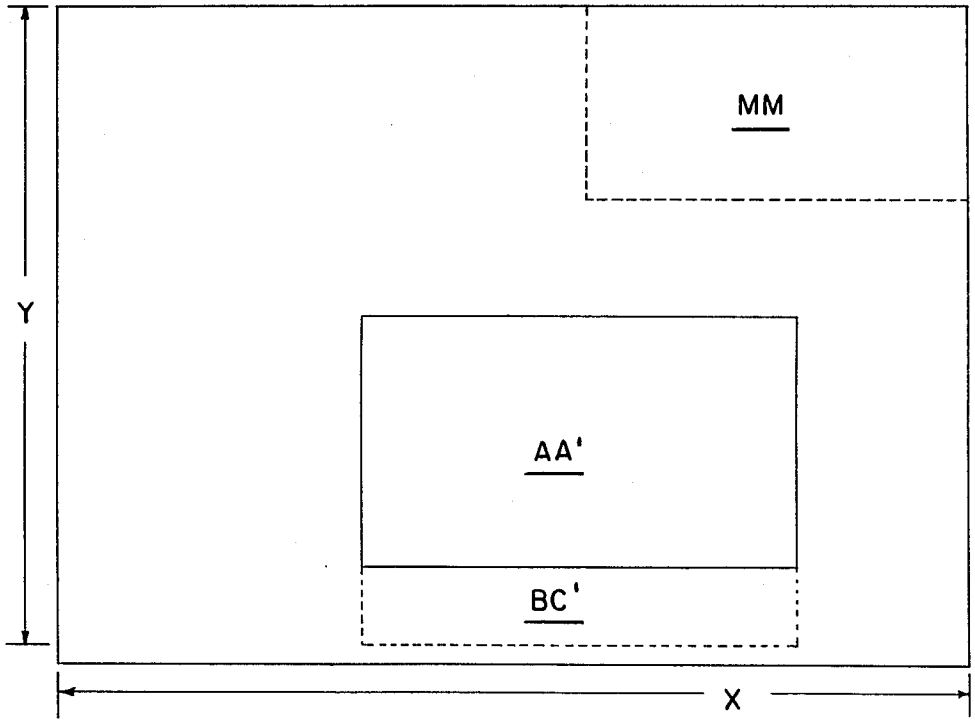
FIG. 2 is a view similar to FIG. 1 illustrating another embodiment of the invention.

Current post card regulations require a minimum of $2\frac{1}{8}$ inches from the right edge of the card for address, postage and postal endorsements. The minimum height or position of the address is unspecified. Postal sorting machines are designed to efficiently read the address for First Class mail within the suggested address position AA shown in FIG. 1. The address area AA' of FIG. 2 is smaller, allowing for a larger return address area and label.

In a preferred embodiment, area AA is a rectangle with right and left edges one (1) inch in from the right and left edges of the post card, respectively. The top edge of area AA is $2\frac{1}{4}$ inches above the bottom of the post card and the bottom edge of area AA is $\frac{5}{8}$ inches above the bottom of the post card. Area AA' is alike in all respects except that the left edge of area AA' is 2 inches from the left edge of the post card and the right edge of area AA' is $1\frac{1}{8}$ inches from the right edge of the post card. The preferred embodiment of the invention, when confined only to an address label, should cover area AA' at minimum.

The address may appear anywhere on the card outside the meter mark area and still be delivered but the preferred position is area AA or AA'.

Accounting data and instructions to the addressee may be shown in the address area AA of the card but must be shown on or surrounded by a shaded background. The unshaded address must then be at least 1 inch high.

(4) The bar code area

The bar code area BC and BC' shown allow for a Zip+4 bar code to be printed on the card for efficient processing by the Post Office. No symbols may appear to the right of the bar code area if this option is used. Since the use of the Zip+4 bar code reduces postage costs, the preferred embodiment includes this area and an imprinted bar code. For purposes of a patent, the bar code area is not necessary, but desirable.

Areas BC and BC' may preferably be a rectangle with the right edge $1\frac{1}{8}$ inches in from the right edge of the post card, the left edge 2 inches in from the left edge of the post card and the botton edge $\frac{1}{8}$ inch above the bottom edge of the post card. The top edge of Area BC is $\frac{3}{8}$ inch above the bottom edge of the post card while the top edge of area BC' is $\frac{1}{2}$ inch above the bottom of the post card.

The Zip+4 option becomes especially important if accounting data or instructions appear in the minimum address area or if the return address label intrudes into the right half of the card. In either of these instances, current postal regulations require the use of Zip+4 to retain post card mailing rates.

Figure 3:
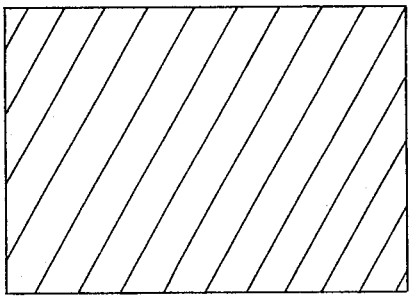
FIGS. 3–9 are schematic views illustrating various arrangements of the card and label (or labels) which may be utilized according to the invention.
Figure 5:
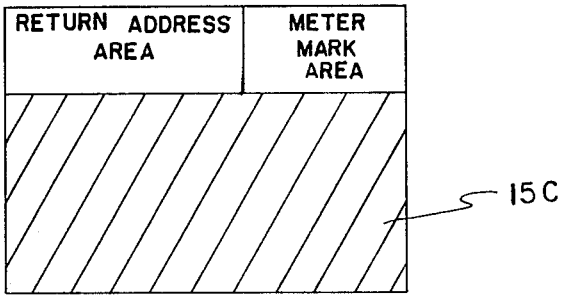
Figure 6:
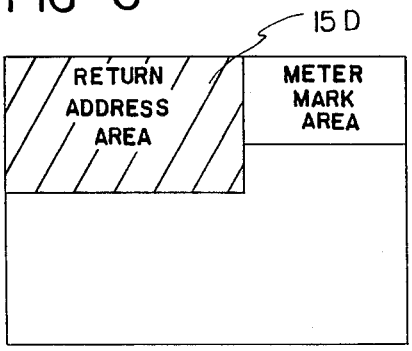
Figure 7:
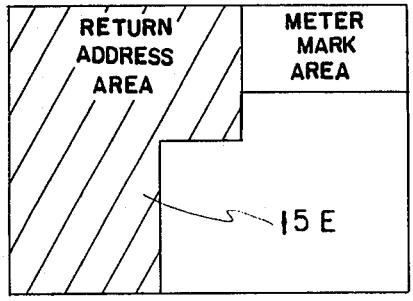

According to the invention the label 15 may take various forms, e.g. sizes and shapes. It may simply cover areas AA or AA' in FIGS. 1 and 2. FIG. 3 illustrates a label 15A (cross-hatched area), which covers the entire face 12 of the post card. In this case the recipient's address and the sender's return address will both be printed on the exposed surface 16, and the postage will be applied to the upper right corner area of the label. It is not mandatory for the return address to be printed on the label, but it usually will be. Such an arrangement allows the interface, at which the confidential information is recorded (printed), to be the full area of the card body 12. The designated label area, on all FIGS. 3–9, allows for the maximum area of the label. For example, the label in FIG. 3 may be $\frac{1}{4}$ inch in from all card edges. The typical height A and width B of the meter mark area MM, at the upper right corner of card body 12, are 1.25 inches (3.175 cm.) and 2.5 inches (6.35 cm.) respectively. If it is found desirable to use pre-printed or pre-metered postage, this can be applied directly to the card face, and the label 15 can then have a height of 2.25 to 3.0 inches (5.715 cm.), extending the full width X of the card body. The form shown in FIG. 4 employs this arrangement, and uses a separate (or combined) return address label 15B, not specified in FIG. 1, while the form shown in FIG. 5 has the return address printed or otherwise applied directly to the upper left region of the card body, above label 15C. The form shown in FIG. 6 utilizes only a larger return address label 15D, at the interface of which the confidential indicia is placed, and the remainder of the card body is uncovered, receiving the recipient's address and the postage in conventional fashion. The form shown in FIG. 7 is like that in FIG. 6 except label 15E extends to or toward the bottom edge of the post card to the left of the recipient's address area. The form of FIG. 9 is similar to the form shown in FIG. 7, except the label 15G covers the card face in the meter mark area MM, and postage is applied to the exposed surface of the label in that area.

Figure 8:
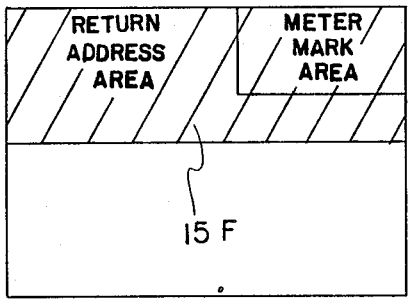
Figure 9:
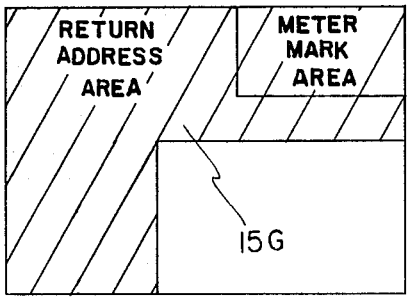

The form shown in FIG. 8 has the label 15F covering the upper one-half (approximately) of the card face, and the return address along with the postage is applied to the exposed surface of the label, while the recipient's address is printed or otherwise placed on the surface 12 of the card body, with the confidential information (indicia) located at the interface of the label and card body. This allows the printing of the recipient's address and the confidential information at the same time, or in readily correlated manner, if that is found desirable.

It is, of course, also possible to provide an embodiment wherein a label covers the right-most portion of the card, extending up to the full height of the card and, for example, at least $2\frac{1}{8}$ inches from the right-hand edge of the card. Similarly a label could be used that covers the left-most portion of the card, extending up to the full height of the card and at most $3\frac{7}{8}$ inches from the left-hand edge of the card.

It will be recognized that various combinations of the above described forms will be better adapted to the particular equipment used to print the addresses and the indicia conveying the confidential information. For example, the forms shown in FIGS. 4 and 5 allow the postage and the return address to be pre-printed by common means, e.g. a form of printing press, and the specialized and related recipient's address and confidential information to be printed in a correlated (essentially simultaneous) manner as with variable output printing devices, e.g. an ink-jet printer, with the confidential information or indicia applied to the reverse side of the label. On the other hand, the forms such as shown in FIGS. 6 and 7 allow correlated printing of the recipient's address and the confidential information (variable data) on the face of the card body, while the labels can have the common return address, and the postage if desired, printed onto the exposed surface of the label.

It will be recognized that the particular embodiment selected for use may depend on the length of the confidential message to be imprinted on the label-card interface. Thus, a longer message may require a larger label, and vice versa.

Figure 4:
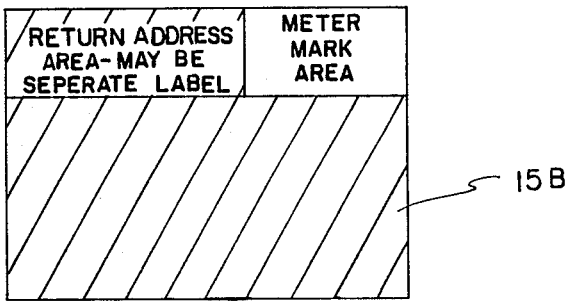

If desired, the return address label can be separate, or separable from, the label 15, to enable its use on a separate return envelope (which might be supplied in quantity to the recipients) and thus facilitate the mailing of a return message to the sender. Such a form is illustrated in FIG. 4.

The labels 15 and/or 20 are preferably affixed to the face 12 of the card body by some means, such as an adhesive which will indicate unauthorized removal of the label 20 (FIG. 1), or tampering with it. For example, a suitable adhesive will not easily pull away from the post card body face, but will tear or pull away at least some part of the face, or the adhesive will not re-attach to the card body of a part or all of the label is pulled away, or the label is surrounded by an edging that cracks or tears when the label is removed or the words "OPENED" appear on the label or card once removed or the label or ink changes color once removed. Thus, confidential integrity of the decipherable indicia or information can be reasonably assured. In any event, the adhesive or other means for attaching the label to the post card body must be sufficiently positive (or have sufficient strength) to allow automatic processing of the post card.

Also, to assist in mechanized processing, it is desirable that an area of the card face 12, or of the exposed surface of the label used, be dedicated to the location of an imprinted bar code. This area is designated BC and BC' on the FIGS. 1 and 2 of the drawing.

The back or reverse surface of the post card body 12 can be utilized, if desired, in a number of ways. Instructions for proper removal of the label, so as not to breach the confidentiality until the recipient desires, can be printed there. In addition, or instead, the card's reverse surface can bear advertising of, or special instructions or announcements from, the sender, where that is appropriate.

The invention thus also encompasses a novel method of sending confidential information from a sender to a recipient at First Class post card postage rates. This method comprises the steps of (a) providing a rectangular opaque card which complies with the U.S. Postal Service regulations as to size, weight, color and stiffness, as set forth above, (b) providing an opaque address label of a size to cover a predetermined area of the face of the card, (c) placing decipherable indicia, which describes data confidential to the sender and recipient, at the interface of the label and the predetermined area of the card, (d) affixing the label to the predetermined area of the card so as to cover at least such predetermined area and conceal the indicia, by means which will indicate tampering with the label such as by partial or complete removal thereof in violation of the security of the confidence of the data conveyed by the indicia.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. A post card for sending confidential data in the form of decipherable indicia from a sender to a recipient who may legitimately share information conveyed by the indicia, comprising a stiff rectangular card body measuring no less than 3.5 inches by 5 inches, said body having a face onto which postage and at least a recipient's address are to be applied and a sender's return address may be applied, said face of said body having a predetermined area within which area confidential indicia may be located;

an opaque label having an exposed surface and a reverse surface securable to said card body and covering said predetermined area;

said label functioning to conceal confidential indicia placed at the interface of said body and said reverse surface of said label; and means securing said label to said card body in such manner that tampering with said label will be detectable by the recipient, said label having on its said exposed surface at least one address.

2. A post card as defined in claim 1, wherein said means securing said label to said card body comprises an adhesive which, when said label is at least partially pulled from said predetermined area, will thereafter indicate tampering with the confidence of the data.

3. A post card as defined in claim 1, wherein said card body is no greater in size than 4.5 inches in height by 6 inches in length.

4. A post card as defined in claim 1 wherein said card body consists of card stock which has a basis weight of at least 125 grams per square meter.

5. A post card as defined in claim 1, wherein the confidential indicia is located on said face of said card body;

the address of the recipient is located on said card body in an area outside said predetermined area; and said label has placed on its said exposed surface the return address of the sender.

6. A post card as defined in claim 1, wherein the confidential indicia is located on said reverse surface of said label;

the address of the recipient is located on said exposed surface of said label; and said card body has placed on its said face outside said predetermined area the return address of the sender.

7. A post card for sending confidential data in the form of decipherable indicia from a sender to a recipient who may legitimately share information conveyed by the indicia, comprising a rectangular body of paper or card stock having a thickness of at least 0.007 and less than or equal to 0.0095 inches and measuring no greater than 4.5 inches by 6 inches and no less than 3.5 inches by 5 inches, said body having a face including a predetermined area for transmitting confidential indicia, an opaque label having an exposed surface and a reverse surface securable to said card body, said label being of an area no greater than said predetermined area and greater than the area occupied by said indicia whereby said label can be secured to said predetermined area of said card body in a position to conceal the confidential data, said indicia being of a type which will not imprint through the card body and being located at the interface of said card body and said reverse surface of said label, means securing said label to said body in such manner that unauthorized tampering with said label will be detectable by the recipient but authorized removal of said label will make said indicia visible to the recipient, said label having on its said exposed surface at least one address.

8. A post card as defined in claim 7, wherein said means securing said label to said card body comprises an adhesive which, when said label is at least partially pulled from said predetermined area, will thereafter indicate tampering with the confidence of the data.

9. A post card as defined in claim 7 wherein said card body consists of card stock which has a basis weight of at least 125 grams per square meter.

10. A post card as defined in claim 7, wherein the confidential indicia is located on said face of said card body;

the address of the recipient is located on said card body in an area outside said predetermined area; and said label has placed on its said exposed surface the return address of the sender.

11. A post card as defined in claim 7, wherein the confidential indicia is located on said reverse surface of said label;

the address of the recipient is located on said exposed surface of said label; and said card body has placed on its said face outside said predetermined area the return address of the sender.

12. The method of sending confidential information from a sender to a recipient using post card postage, comprising the steps of (a) providing a rectangular opaque card which complies with the U.S. Postal Service regulations as to size, weight, color and stiffness, (b) providing an opaque address label of a size to cover a predetermined area of the face of the card, (c) placing decipherable indicia, which describes data confidential to the sender and recipient, at the interface of the label and the predetermined area of the card, (d) affixing the label to the card so as to cover at least such predetermined area and conceal the indicia, by means which will indicate tampering with the label such as partial or complete removal thereof in violation of the security of the confidence of the data conveyed by the indicia.

* * * * *